US010281881B2

(12) United States Patent
Reece

(10) Patent No.: US 10,281,881 B2
(45) Date of Patent: May 7, 2019

(54) ALARM APPARATUS

(71) Applicant: Callum Reece, Middlesex (GB)

(72) Inventor: Callum Reece, Middlesex (GB)

( * ) Notice: Subject to any disclaimer, the term of this patent is extended or adjusted under 35 U.S.C. 154(b) by 0 days.

(21) Appl. No.: 15/538,021

(22) PCT Filed: Dec. 22, 2015

(86) PCT No.: PCT/IB2015/059879
§ 371 (c)(1),
(2) Date: Jun. 20, 2017

(87) PCT Pub. No.: WO2016/103175
PCT Pub. Date: Jun. 30, 2016

(65) Prior Publication Data

US 2017/0351224 A1 Dec. 7, 2017

(30) Foreign Application Priority Data

Dec. 22, 2014 (GB) ..... 1422897.7

(51) Int. Cl.
*G04G 13/02* (2006.01)
*G04B 47/00* (2006.01)

(52) U.S. Cl.
CPC ..... *G04G 13/026* (2013.01); *G04G 13/021* (2013.01); *G04B 47/00* (2013.01)

(58) Field of Classification Search
CPC .... G04G 13/026; G04G 13/021; G04G 13/02; G04G 13/025; G04G 13/028; G04B 47/00
See application file for complete search history.

(56) References Cited

U.S. PATENT DOCUMENTS 4,144,706 A * 3/1979 Willis ..... G04G 13/02 368/12
5,686,882 A * 11/1997 Giani ..... G04G 13/028 340/407.1
5,708,629 A * 1/1998 Hung-Hsu ..... G04B 23/03 368/12

(Continued)

FOREIGN PATENT DOCUMENTS

CN 202421775 9/2012
CN 203965815 11/2014

(Continued)

OTHER PUBLICATIONS

Patents Act 1977: Examination Report under Section 18(3) dated Sep. 2, 2015 in United Kingdom Patent Application No. 1422897.7.

(Continued)

*Primary Examiner* — Sean P Kayes
(74) *Attorney, Agent, or Firm* — William H. Bollman

(57) ABSTRACT

An alarm apparatus, in particular an alarm apparatus having at least two separate parts, includes an alarm unit and a user portion for generating a localized alert. The user portion has an attachment means for attaching the user portion about or onto a part of the user's body. The user portion includes a lock which in use is adapted to lock the user portion about or onto a part of the user's body. The alarm unit and user portion in use are located apart one from another and the lock is adapted to unlock upon presentation of the user portion to the alarm unit.

18 Claims, 17 Drawing Sheets

(56) References Cited

U.S. PATENT DOCUMENTS

| | | | | |
|---|---|---|---|---|
| 5,764,594 | A * | 6/1998 | Berman | G04B 25/04 368/12 |
| 7,173,881 | B1 | 2/2007 | Freudenberg, Jr. et al. | |
| 9,285,779 | B2 * | 3/2016 | Almudafier | G04G 15/00 |
| 2007/0008825 | A1 * | 1/2007 | Tang | G04B 25/04 368/73 |
| 2007/0216537 | A1 | 9/2007 | Park | |
| 2011/0169620 | A1 * | 7/2011 | Yang | G04G 13/02 340/309.16 |
| 2011/0235469 | A1 | 9/2011 | Irwin | |
| 2013/0208575 | A1 * | 8/2013 | Sammut | G04G 13/021 368/250 |
| 2015/0277388 | A1 * | 10/2015 | Almudafier | G04G 15/00 368/11 |

FOREIGN PATENT DOCUMENTS

| | | |
|---|---|---|
| GB | 2 453 178 | 4/2009 |
| GB | 2505981 | 3/2014 |
| WO | 2004/044606 | 5/2004 |

OTHER PUBLICATIONS

Patents Act 1977: Search Report under Section 17(6) dated Jan. 29, 2016 in United Kingdom Patent Application No. 1422897.7.

Patents Act 1977: Combined Search and Examination Report under Sections 17 and 18(3) dated Apr. 30, 2015 in United Kingdom Patent Application No. 1422897.7.

International Search Report and Written Opinion dated Apr. 7, 2016 in International Application No. PCT/IB2015/059879.

* cited by examiner

ALARM APPARATUS

FIELD OF THE INVENTION

The present invention relates to alarm apparatus, in particular an alarm apparatus having at least two separate parts comprising a first alarm unit and a second user portion that are capable of communication one with another.

BACKGROUND

Increasing pressures of modern life tend to make it difficult for many to wake up promptly in the morning in response to an alarm.

This particularly leads many users to repeatedly press snooze buttons or ignore an alarm they have set for themselves. This may mean a user wakes up later than intended and can risk potentially disastrous consequences by not waking at the desired time.

PRIOR ART

U.S. Pat. No. 4,144,706 (Willis) discloses an alarm device comprising a wrist watch with timing and alarm setting elements with separate alarm box containing a sensor and sonic generator alarm.

U.S. Pat. No. 7,173,881 (Fehringer et al) discloses an alarm system comprising: a multiple alarm devices including an alarm clock, a telephone, and a door bell. Each alarm device includes means for generating an alarm signal, and a transmitter connected to each said generating means for transmitting an alarm signal at a frequency different for each of said alarm devices and selected users, so that each alarm device issues a different frequency signal for each selected user. A silent notification device comprises a vibration module for each of said users including a receiver for receiving an alarm signal at a selected frequency unique to a specific user and to a specific alarm device. A means is provided in each notification device for alerting a user that said notification device has received an alarm signal from a particular alarm device. Each notification device receives alarm signals from more than one alarm device so that each user receives alarm signals from different alarm devices. Each vibration module is selectively programmable by a user to change individually the intensity of either a light pulse or a strong pulse and a pattern of vibrations which comprise one of a continuous pulse short intermittent pulses, long intermittent pulses, or long/short intermittent pulses to indicate to a user which alarm device is issuing the alarm signal. Each vibration module is mounted on a wrist band worn by a user.

Chinese utility model CN 202 421 775 (Ziyu) discloses an electric shock alarm clock, which comprises an alarm clock, an alarm clock switch, a wire, a plurality of electric shock points, a tourniquet and a magic tape.

U.S. Pat. No. 4,144,706A (Willis) discloses an alarm device comprising a wrist watch with timing and alarm setting elements with separate alarm box containing a sensor and sonic generator alarm.

Chinese Utility Model CN203965815U (UXT) discloses a vibration ring alarm clock which comprises a base and a ring.

The present invention provides an alarm apparatus that serves to ensure a user arises from bed when prompted rather than ignoring or delaying an alarm.

SUMMARY OF THE INVENTION

According to the present invention there is provided alarm apparatus comprising: an alarm unit and a user portion for generating a localised alert, the user portion has an attachment means for attaching the user portion about or onto a part of the user's body, the user portion includes a lock which in use is adapted to lock the user portion about or onto a part of the user's body, the alarm unit and user portion in use are located apart one from another and the lock is adapted to unlock and/or disable the alert upon presentation of the user portion to the alarm unit.

In this way the user portion is attached to the user, typically around a user's wrist, whilst the user is sleeping. The user portion is programmed to provide a localised alert at a pre-selected time so as to wake the user. As the user portion is locked it cannot be removed (or switched off) without being presented to the alarm unit. Therefore a user must physically get up and travel to the alarm unit, which is ideally located at a distance from the user's sleeping location, so that the user is forced to get up and walk some distance in order to unlock and/or disable the localised alert.

In use the alarm unit and user portion are separate and configured for co-location in close proximity in order to unlock the user portion from a user and/or in order to disable the localised alert emitted by the user portion.

In some embodiments the alarm unit is also capable of generating an alert independent of the localised alert.

The connection between the alarm unit and user portion may be a temporary physical connection or a wireless connection made within a pre-determined range or proximity. The proximity in which the connection between the alarm unit and user portion can be activated is defined as a pre-set distance relative to the alarm unit, thereby defining a zone in which the user portion can be unlocked and/or the alert disabled. For example the user portion may be unlocked and/or the user portion alert may be disabled when with within 300 mm or less of the alarm unit.

It is appreciated that the size of the zone is dependent on the means used to unlock and/or disable the user portion.

In some embodiments more than one zone may be defined, for example so that a first zone is provided for unlocking the user portion and disabling the alert and a second zone is provided for example to receive data from a remote device such as a mobile phone.

The connection between the alarm unit and user portion(s) permits communication between the alarm unit and with the user portion so as to permit alert data to be transferred between the user portion and alarm unit. The alert data may include but is not limited to: time, type of alert, duration of alert, combination of alerts, snooze periods, volume and/or intensity of alert. Other data may be transmitted relating to, for example, the user's sleep activity or other biometric data, such as breathing and/or pulse and/or perspiration that has occurred during sleep. This data may be stored or used as part of a healthy lifestyle or exercise regime enabling a user to monitor and analyse their health.

Typically the alarm unit is programmed by a user with a time at which the user is required to wake.

The alarm unit includes controls such as buttons or sensors as well as a display to enable a user to program or set the parameters.

Preferably the display shows the time and alert parameters. In some embodiments the display may comprise a capacitance screen so as to enable touch screen use.

Data is relayed to the user portion from the alarm unit so that a corresponding localised alert can be generated by the user portion at the pre-programmed time. The data may be relayed whilst the user portion is in close proximity or in physical connection with the alarm unit so that the data is stored on the user portion or it may be relayed via wireless router, short message service (SMS), or any other wireless air protocol (WAP).

Alternatively a wireless signal may be transmitted to the user portion to trigger the alert or a wireless signal may be relayed through a third party device such as a mobile communication device such as a cellphone.

In a preferred embodiment the user portion includes a timer that is set by the alarm unit. The timer serves to trigger a means for generating the localised alert. For example an electrical impulse may be provided to activate a vibrating module which is powered by one or more batteries housed in the user portion.

Alternatively or additionally the alarm unit may emit an alarm signal at the desired time that is detected by the user portion so as to trigger the localised alert.

The alarm unit ideally communicates with the user portion wirelessly, for example by Bluetooth® or Radio Frequency (RF) or by means of a physical connection such as a wired connection or docking means, or by any combination of the before mentioned means.

The alarm apparatus typically include a wireless transmitter that transmits a signal which activates a means to trigger the localised alert at the user portion. The user portion typically also has a wireless receiver to receive the transmitted signals. In these ways the alarm unit can provide an alarm signals to the user portion.

In some embodiments the alarm unit and user portion may each include transmitters and receivers so as to transmit and receive signals to enable two-way communication.

The signals sent between the alarm unit and user portion may include but are not limited to: setting one or more alert parameters in the timer, selecting the type of alert emitted, snooze periods, volume, increasing intensity mode and duration.

In this way for example a user is able to pre-set one or more alarm types, for example setting daily alarms over a period of time such a working week or seven days. Typically the alarm unit includes a menu from which alert parameters can be set so as to alter alarm regime, set volumes, record location of user portions and/or the alarm unit.

The alarm unit includes a memory means so as to be capable of storing data relating to one or more of the aforementioned parameters of the alert.

It is appreciated that in some embodiments the alarm unit may be configured for communication with two or more user portions. Thereby enabling a plurality of alerts to be controlled by means of a single alarm unit. Each user portion may be set independently or jointly depending on requirements, thus ensuring that all members of a team are awoken on campus say at the same time in order to arrive promptly at an early morning training event. Alternatively the memory means may therefore store different user details so that different alarms can be provided for a household.

The memory means is typically part of a printed circuit board assembly which includes random access memory (RAM) as well as microprocessor and clock.

In some embodiments a third party device such as a mobile phone may be arranged to synchronise with the alarm apparatus so as to be capable of communication with the alarm unit and/or user portion. For example, an application (or APP) on a mobile communication device or cellphone (smart phone) may be provided that can be used to set alert parameters on the alarm apparatus whereby a signal is sent from the mobile communication device to the alarm unit and/or user portion, rather than a user setting an alarm time on the alarm unit.

The APP typically includes at least one menu so as to enable a user to select the parameters of the alarm apparatus such as alarm regime, snooze periods, volumes, location of user portions and/or alarm unit.

It is appreciated that once the alert times have been set and accepted they cannot be altered without connection between the user portion and alarm unit, thereby preventing a user overriding the alarm using any other mobile device or cellphone.

In preferred embodiments the attachment means of the user portion comprises a lock, typically comprising a mechanical locking closure mechanism. The lock may include but is not limited to interlocking portions such as a clasp, a buckle, a magnetic means, a ratchet or a detent mechanism.

In other embodiments the ends comprise a hook and eye mechanism, a hook and loop mechanism such as Velcro®, a, catch or clip mechanism or ball and socket arrangement.

Advantageously the attachment mechanism is secure and maintains the user portion partly or wholly against the user's skin. In this way the user portion is less liable to suffer damage or dislocate during wear, for example during sleeping movements at night time.

In still further embodiments the user portion may include an elasticated section wherein the user portion is held against the user by the elasticity of the elastic section so as to permit flexibility, for example to allow for swelling of the user's arm.

In other embodiments a tightening or striction mechanism may be provided to ensure that the portion is held tightly against the user at all times, in this way the user portion can be fitted and then adjusted in-situ. In some embodiments the mechanism for tightening is analogous to the user attachment mechanism, wherein the user portion is tight to the user when attached and/or not capable of being un-tightened, for example a ratchet strap attachment similar to a cable tie mechanism.

The attachment means of the user portion typically provides a means by which the user portion may be attached about a limb such as arm, wrist, leg or ankle, passing around and attaching itself, for example in the form of a wristband or bracelet.

Advantageously therefore the user portion or portion in use is carried by or worn on the user at relevant times and any alert generated by the user portion is local to the user's body being set according to user preference or manufacturer configuration.

The user portion has a lock, so as to lock the attachment means, thereby preventing removal from a user. In preferred embodiments the lock may be released only by connection with the alarm unit (physical or proximity connection); wherein the user is compelled to visit the alarm unit in order to unlock and consequently remove the user portion.

In some embodiments a cease notification control may be located on an inner face of the user portion, which is only accessible by unlocking the user portion so that this region can be accessed. In other embodiments unlocking and thereby opening the user attachment mechanism may cause the localised alert notification to cease.

In some embodiments the user attachment mechanism comprises a mechanical connection, wherein for example magnetic forces are passed between the alarm unit and user portion, so as to activate or deactivate elements within the user portion. In another embodiment a key may be provided on the unit to release the mechanism.

In yet further embodiments a proximity signal may be utilised to unlock the attachment mechanism wherein, when the user portion is positioned within a pre-set distance of the alarm unit for a predetermined period of time the user portion is unlocked from the user. For example the user portion may be located within 50 mm of the alarm unit for at least 3 seconds.

In preferred embodiments the user portion is a wristband having a locking closure mechanism comprising a channel at a first end of the wristband that receives the second end of the wristband. Once the wristband is arranged at the desired circumference the second end is locked into position. Typically the second end of the wristband includes a plurality of grooves and the channel includes at least one corresponding projection that can be clamped into the corresponding grooves so as to be locked in position.

Preferably the user portion is formed at least in part of a flexible material, so as to enable wrapping around a part of the user's body in use. For example the wristband may be formed from a resiliently deformable, durable material such as rubber.

The user portion thereby typically comprises a band or elongate portion such that the user portion has ends that include the user attachment mechanism. For example in some embodiments the ends comprise mating parts so as to interlock both ends of the user portion together forming a locked loop.

In some embodiments a central section of the user portion between the first and second ends may comprise the electrical workings of the user portion such as the means to provide the localised alert, the battery etc. Said section may be configured to be in contact with a particular area of the user's body part, for example the wrist.

In some preferred embodiments the section containing the workings is configured with a substantially planar inner profile, for contact with an inner or outer wrist, wherein peripheral sections comprise elasticity or flexibility, so as to accommodate curvature.

Preferably the localised alert generated by the user portion or alarm signal notification emitted by the alarm unit can only be deactivated by unlocking the lock. In this way the user cannot override the alert on the user portion without connecting the user portion with the alarm unit so as to unlock the closure. Therefore the user is compelled to travel to the unit to turn off the local signal notification.

The localised alert generated by the user portion may be an audible, visual and/or haptic, therefore providing different forms of stimulus to a user.

In preferred embodiments the localised alert of the user portion comprises a haptic alert means which provide a sensation to the user's body part locally. In some embodiments this haptic sensation comprises a vibration module.

The localised alert of the user portion may preferably comprise an electric shock means, wherein the portion comprises at least two contact points so as to transmit a mild electric shock to a user. These contact points are configured to provide electrical contacts with the user's skin.

In some further embodiments the inner section of the wristband may use exposed electrode pads to issue a shock or unpleasant vibration to the user, or in other embodiments a rigid section could itself vibrate vigorously in addition or alternative.

These electrical contact points may comprise metallic domes, or tapered metallic points, configured to ensure multidirectional contact possibilities, and arranged so as to ensure there is minimal chance of the contact being non-continuous. The portion is configured to hold the points against the skin.

The points comprise negative and positive terminals of an open circuit within the portion wherein in use the alarm means comprises opening of an electric impulse through this internal circuit, wherein the points allow use of the user's body to close the circuit. The electrical impulse is provided by a plurality of pins, which pins in use are ideally in contact with the user's inner wrist.

In preferred embodiments the pins are used to charge the portion when the portion is united on the unit.

In some embodiments an alert may be triggered at the user portion, at the alarm unit and/or an independent device, therefore making it harder for a user to ignore these multiple alarm signals. Each alert may be different.

If the user ignores the alarm signal for a period that is not in line with parameters, the alert generated may change so as to be more invasive or annoying to a user so forcing them to get up.

For example a first alert may be a user's standard mobile phone alarm. A second alert may be the alarm unit generating an audible alert and the third alert may be the user portion generating a vibrating alert.

In some embodiments the user portion may include a snooze function or control, for example having a button arranged to cease the alert and/or transmit a signal to the alarm unit to cease alert signals being transmitted to the user portion. For example in some embodiments the apparatus may be configured to allow for a limited number of snoozes of the alert before volume or intensity of the alert(s) is/are increased.

For example a standard audible alert may be generated on the time for which the alarm has been set. If the user portion is not connected with the alarm unit within a pre-selected period of time, such as one minute, the localised alert may increase in volume and/or an additional alert such as a vibration alert may be triggered. Thus forcing a user to get up and travel to the alarm unit in order to unlock the user portion from them and disable the alert(s).

In some embodiments the initial alarm may be generated by the remote alarm unit so that a less invasive alarm signal may be first generated at a distance from the user, so as to draw initial attention; and a second more invasive and local alarm signal notification may be generated locally on the user portion, to ensure that the alarm signal is acted upon. Therefore the alarm apparatus on this setting has two alerts, a first alert triggered on the alarm unit and a second alert triggered on the user portion.

In some embodiments the apparatus is configured to measure the distance between the alarm unit and user portion to ensure the parts are arranged sufficiently far apart that a user must travel to the alarm unit. That is the alarm unit cannot be reached without getting up. In such embodiments an alert may be triggered by the apparatus to advise that the parts are located too closely together.

In some embodiments the battery in the user portion is rechargeable. In such embodiments the user portion may include an electrical connection by means of a charging port. For example the battery is recharged when the user portion is connected to a power supply, and consequently the user portion and alarm units preferably each include a port to permit electrical connection. In some other embodiments the user portion may be charged through inductive charging.

In some embodiments the alarm apparatus may include a second port that permits data transfer between the alarm unit and user portion. In some embodiments a port may permit charging and data transfer.

Advantageously therefore the alarm unit may be used to set time periods for the user portion wherein this data is transferred to the user portion from the alarm unit by means of connection between the data ports on each part. For example a wire may be connected between the user portion and alarm unit or the user portion may be received by a port on the alarm unit in the form of a docking station. In this way wireless signals may be avoided or minimised, so as to reassure users with concerns over being exposed to wireless signals.

Advantageously the ports may be provided on the user portion and alarm unit so that connection of the user portion can be made into or onto the alarm unit. Advantageously therefore the user portion may be plugged into the alarm unit when not in use, with the battery for example remaining charged during the day, and ready for use in the night.

The alarm unit may be connected to a mains electrical supply so as to have a constant power supply and may in some embodiments include a mains electrical connection.

The alarm unit may include a safety mechanism that ensures that the alarm unit has sufficient charge to unlock the lock so as to ensure the user portion can always be removed.

An override button or system may be provided so that the user portion can be removed from the user even if power of the alarm unit was depleted. For example the alarm unit may include a second battery that activates only on power failure from the mains or primary battery(ies).

In some preferred embodiments the alarm unit is adapted to receive the user portion, for example having a recess in which the user portion can be located when not in use or a ledge on which the user portion can be placed. Advantageously the alarm unit may be adapted in such a way that the user portion is charged whilst arranged on the alarm unit.

Preferably the alarm unit and/or user portion includes a means to prevent the user portion locking whilst located on the alarm unit (and not on the user). For example a mechanism is provided to prevent the lock activating when position on the alarm unit whilst not in use. In this way the user portion can be readily removed from the alarm unit and positioned on the user.

In some embodiments the alarm unit may include a highlighted area against which the user portion is presented for unlocking and disabling of alerts. For example a section of the alarm unit may be shaped or coloured in such a way that it is readily identified by a user.

Preferred embodiments of the invention will now be described with reference to the Figures in which:

DETAILED DESCRIPTION OF FIGURES

The alarm apparatus shown in FIGS. 1 to 6 shows one embodiment of the apparatus 300 wherein there is provided an alarm unit 100 and a user portion 200.

Figure 4A:
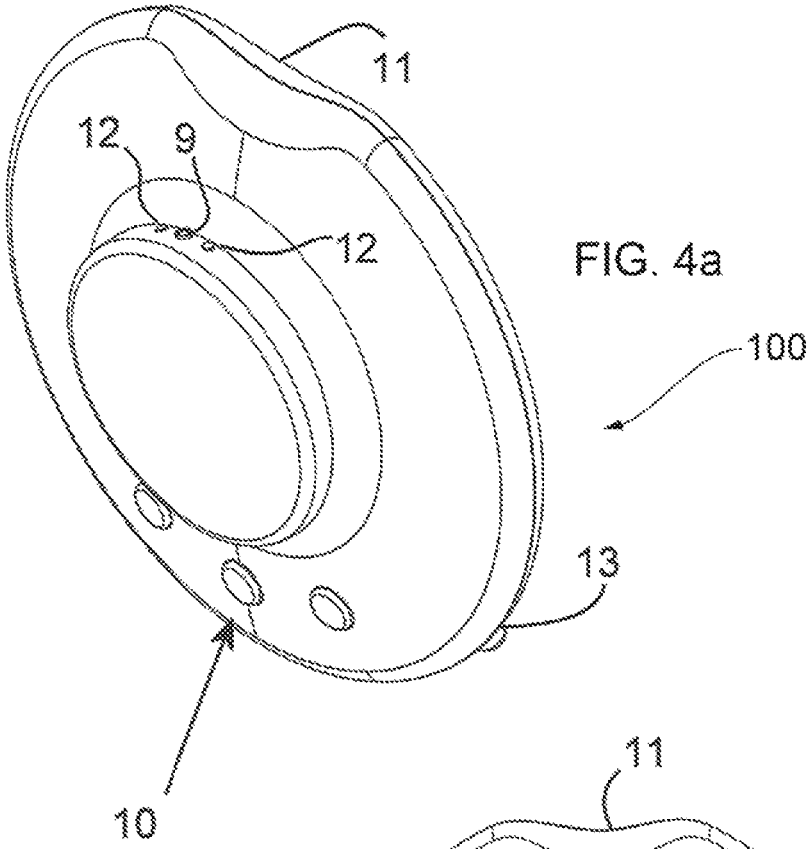
FIG. 4A shows an isometric view of the unit as shown in FIG. 1A.
Figure 4B:
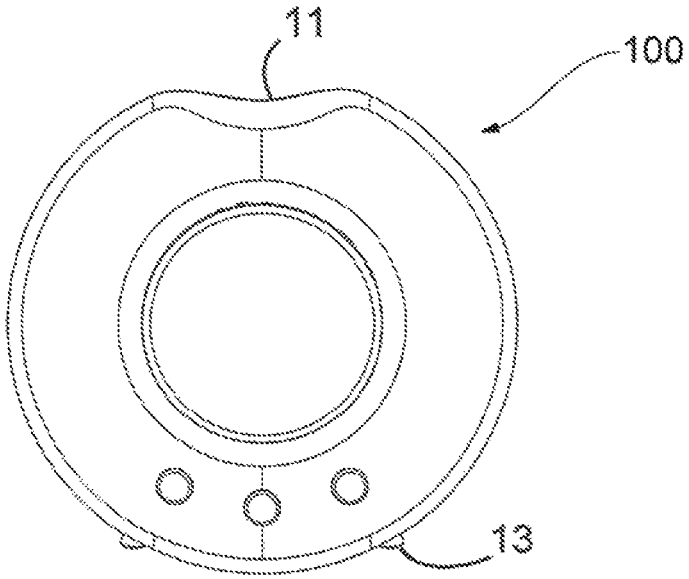
FIG. 4B shows a front view of the unit as shown in FIG. 1A.
Figure 5A:
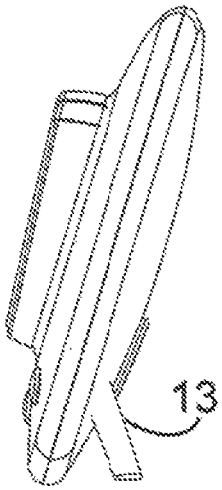
FIGS. 5A, 5B and 5C show views of the unit as shown in FIG. 1*a;*
Figure 5B:
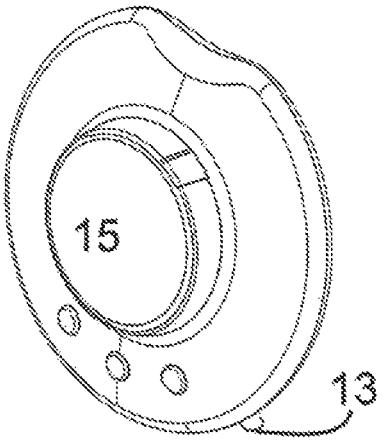
Figure 5C:
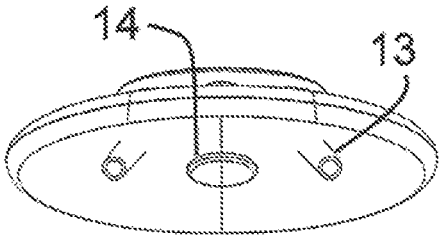
Figure 5D:
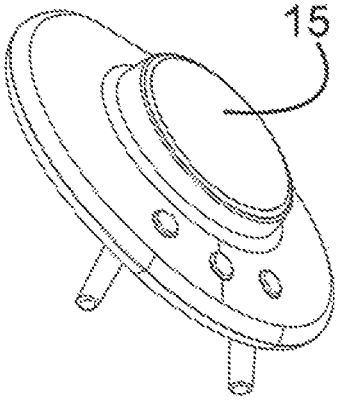

The user portion 200 as shown specifically in FIGS. 3A, 3B, 3C and 3D is comprised of a flexible strap 7, with an inflexible housing 6,8 that comprises the user attachment mechanism 1. The user portion 200 is stored and charged on the alarm unit 200 as shown in FIGS. 4A and 4B and the alert can be set for the user portion and alarm unit using the control buttons 10 on the alarm unit.

The flexible strap 7 is inelastic so that once attached it cannot be pulled away from contact with the user. The user portion 200 is therefore able to be sold in different sizes to ensure it is fitted tightly to the desired user, so preventing removal unless the user portion is unlocked to the open configuration. For example the user portion may be provided in small, medium, large and extra-large sizes.

In other embodiments the flexible strap 7 may include a ratchet strap type attachment mechanism to ensure a tight fit such as a cable tie.

The housing 6, 8, includes a flexible or curved PCB 17 that has a timer (not shown) which can be set at the alarm unit 100. The desired time is set on the alarm unit 100 and this data is transferred to the user portion 200 so as to generate the localised alert at the pre-set time.

Two ends of the flexible strap 7 are joined by a locking mechanism 1 so as to form a locked loop, thereby locking the user portion 200 to the user. The flexible strap 7 is formed from a non-elastic silicone band.

The locking mechanism 1 is in the form of a clasp which is unlocked by swiping or locating the housing 6, 8 in the indentation 11 of the alarm unit 100, above the display screen 15.

Figure 6A:
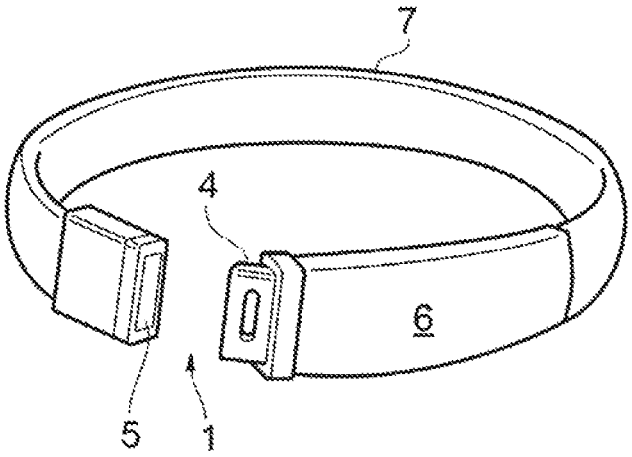
FIGS. 6A, 6B and 6C show sketch views of a second embodiment of the user portion.
Figure 6B:
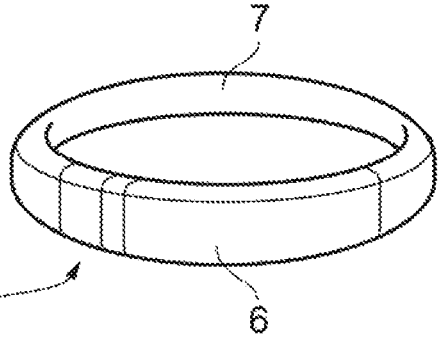

The alarm unit 100 includes a magnetic mechanism (not shown) within the housing 6, 8 to unlock the clasp locking mechanism 1 that is operated by internally displacing catch 5 and loop 4 (see FIG. 6A).

Typically a sprung pin (not shown) locks the catch 5 and loop 4 together, which a magnetic force from the alarm unit 100 pulls open so as to unlock the mechanism.

Such magnetic force may only be operated by the alarm unit 100 upon recognition of a variable, such as a time variable or digital signal; wherein the magnet comprises an electromagnet. In some further embodiments Radio Frequency Identification (RFID) may be utilised so as to recognise the user portion 200.

Referring to FIG. 4A, charging pins 12, 9 locate and connect with points on the user portion 200 for when in non-use so as to permit charging and data transfer. A central recess 11 locates the user portion 200 for unlocking during use. The housing 6, 8 is formed from a rigid polymer and houses electronic components such as the PCB 17, battery 18 and the locking mechanism 1.

Electrode points 2 issue an electric shock and/or targeted vibration points. The alarm unit 100 includes an on/off button 14 so that they alarm unit can be turned off when not in use or when the apparatus is fully charged.

Housing for the alarm unit 100 electrical components is made from a synthetic plastics polymer. In some embodiments the alarm unit 100 has a metallic finish, for example brushed stainless steel.

The alarm unit 100 includes the recess 11 that has a user attachment mechanism override section, comprising an electromagnet (not shown) so as to permit unlocking of the user portion.

Figure 1A:
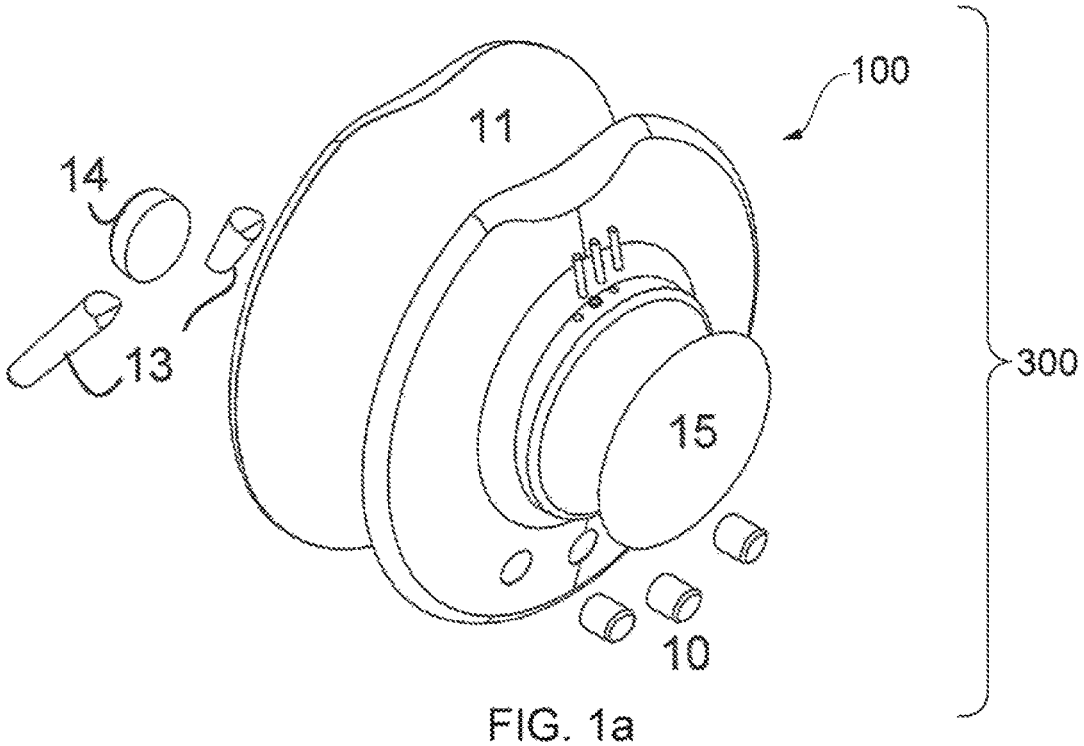
FIG. 1 show an exploded isometric view of embodiments of the portion and unit.
Figure 1B:
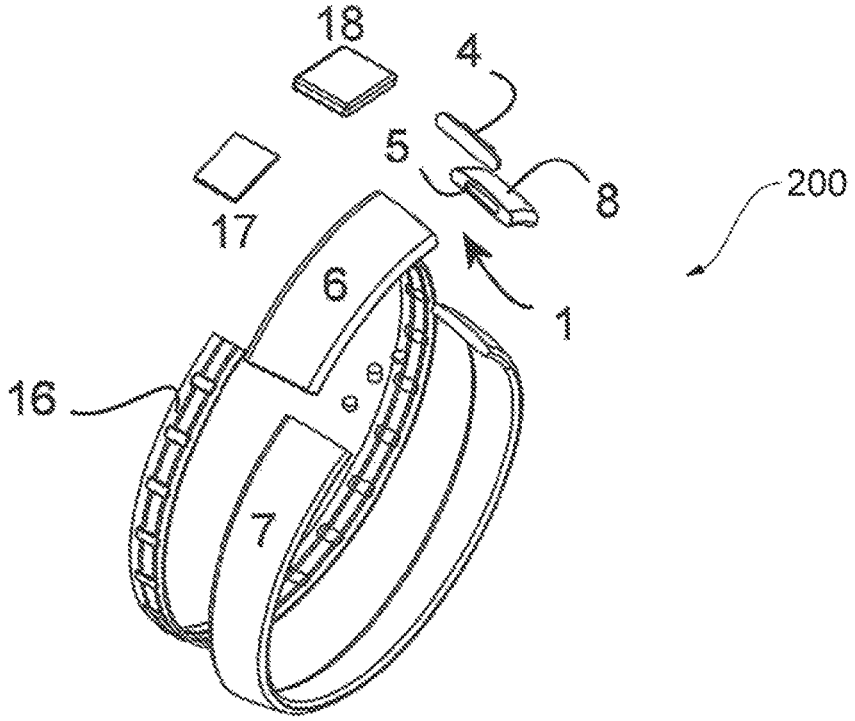
Figure 2:
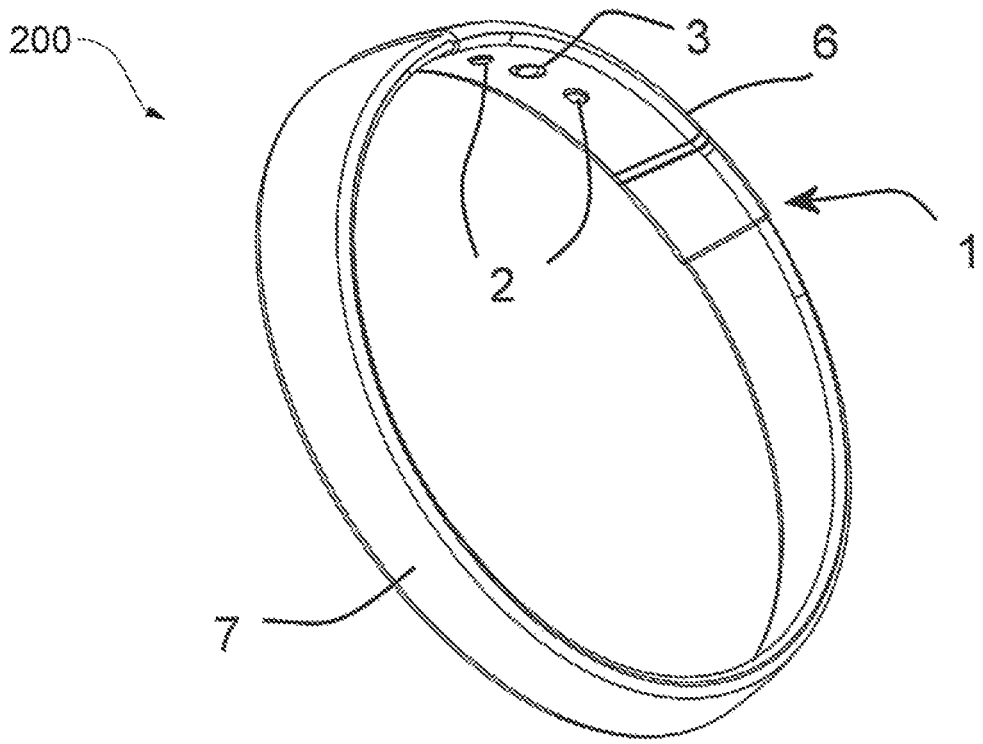
FIG. 2 shows an isometric view of the portion shown in FIG. 1B.
Figures 3A, 3B, 3C, 3D:
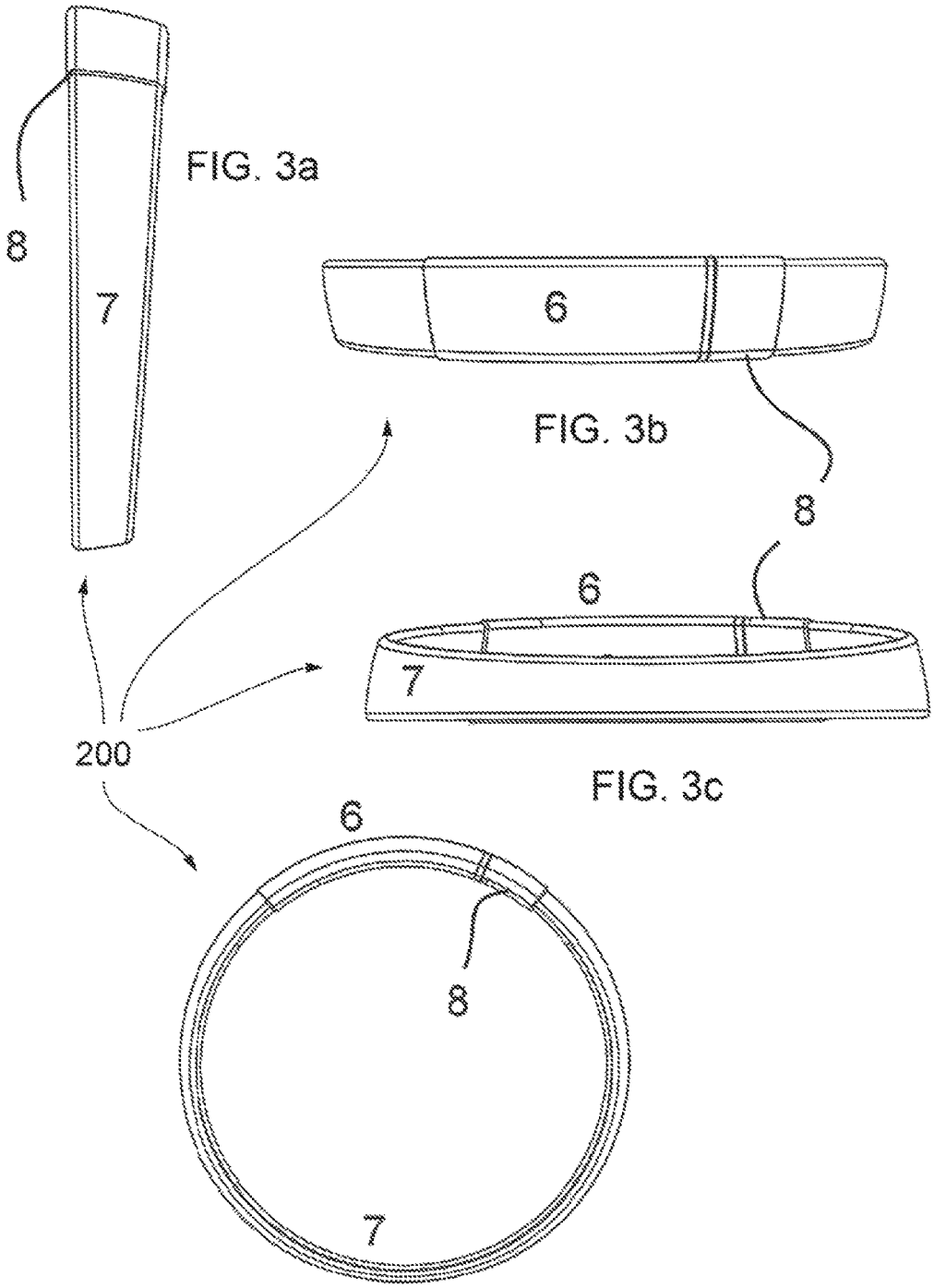
FIGS. 3A to 3A show side views of the user portion as shown in FIG. 1B.
FIG. 3D shows a plan view of the user portion as shown in FIG. 1B.
Figure 6C:
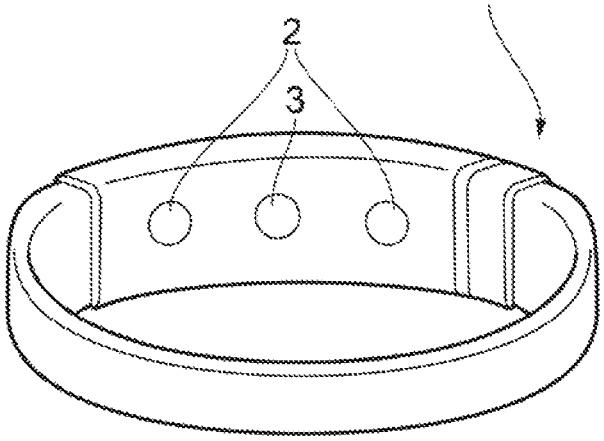

FIGS. 2 and 6C show an inner face of the user portion 200 wherein a port 3 is provided for connecting the user portion 200 to the alarm unit 100 for charging.

The alarm unit 100 includes a stand 13 in the form of two legs that permit the alarm unit 100 to be positioned on a surface wherein the display 15 can be easily viewed and the user portion 200 readily located on the alarm unit 100. A front face of the alarm unit 100 includes controls 10 (See FIG. 4A) providing a user interface by which the alarm apparatus 300 can be operated, for example wherein parameter settings can be changed.

Screen 15 displays time and functions of the alarm apparatus, so that for example a user can see the current time and the time at which the alert will be triggers. The screen 15 may also indicate the selection of alerts that are set to be triggered, for example audible, visual and/or haptic.

Figure 7:
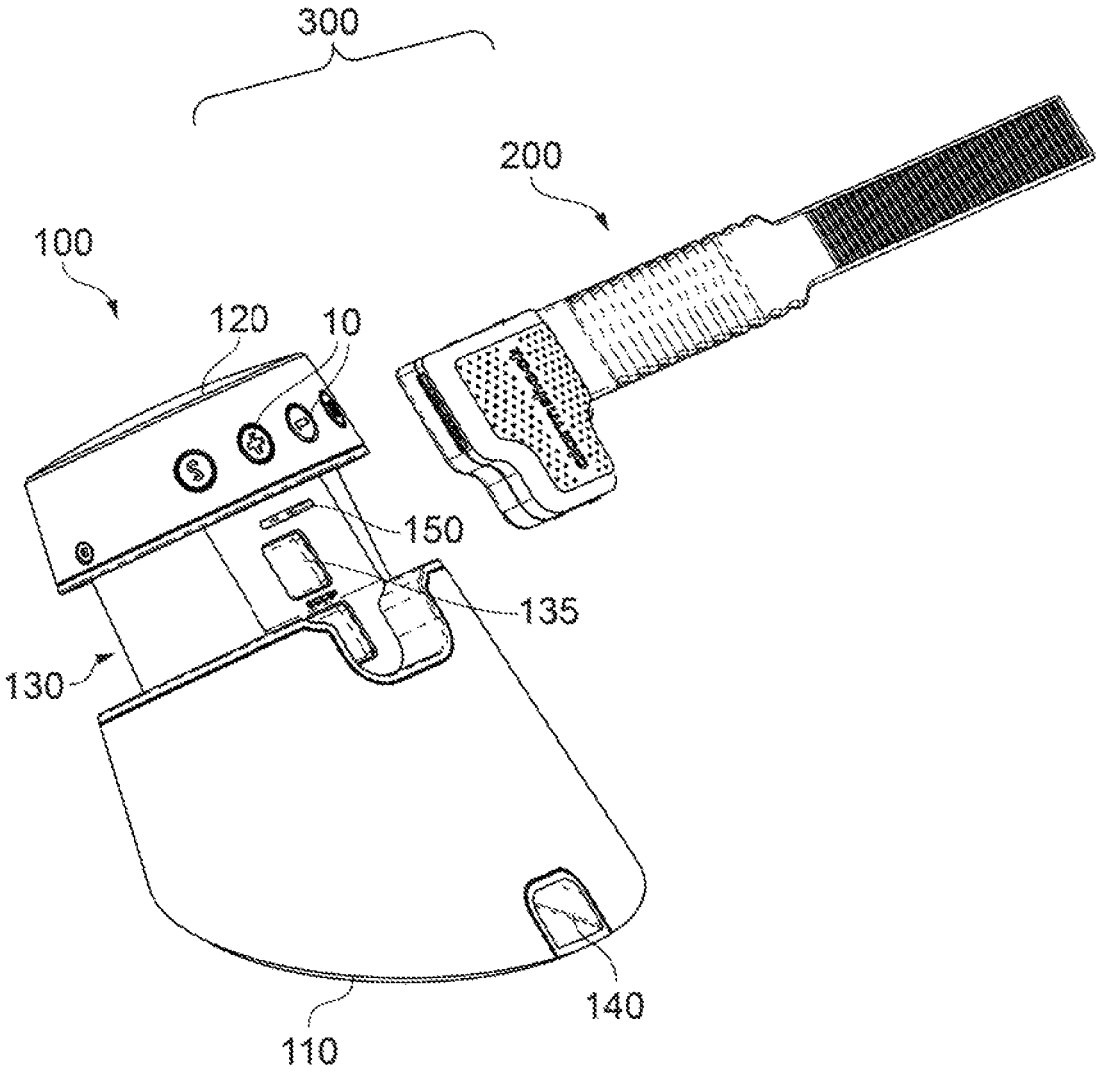
FIG. 7 shows a second embodiment of the alarm apparatus.
Figure 8:
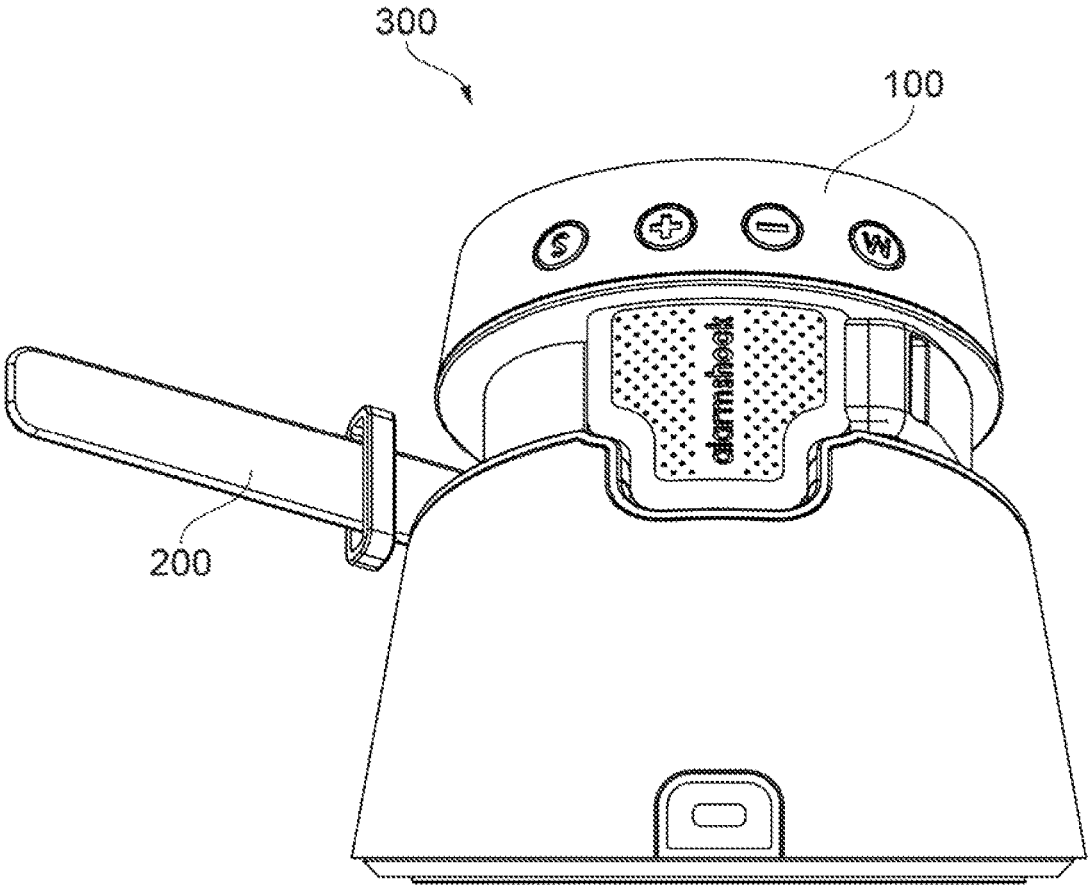
FIG. 8 shows a front view of the user portion mounted on the alarm unit.
Figure 9:
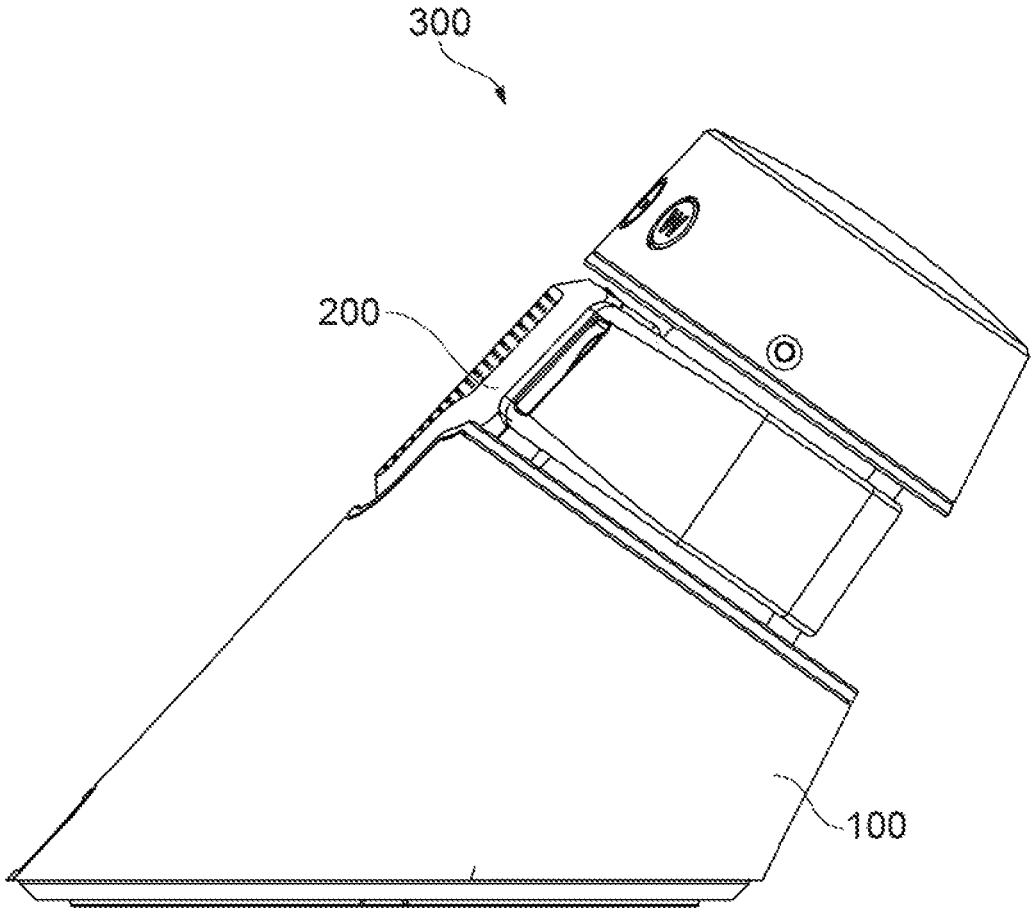
FIG. 9 shows a left side view of the user portion mounted on the alarm unit.
Figure 10:
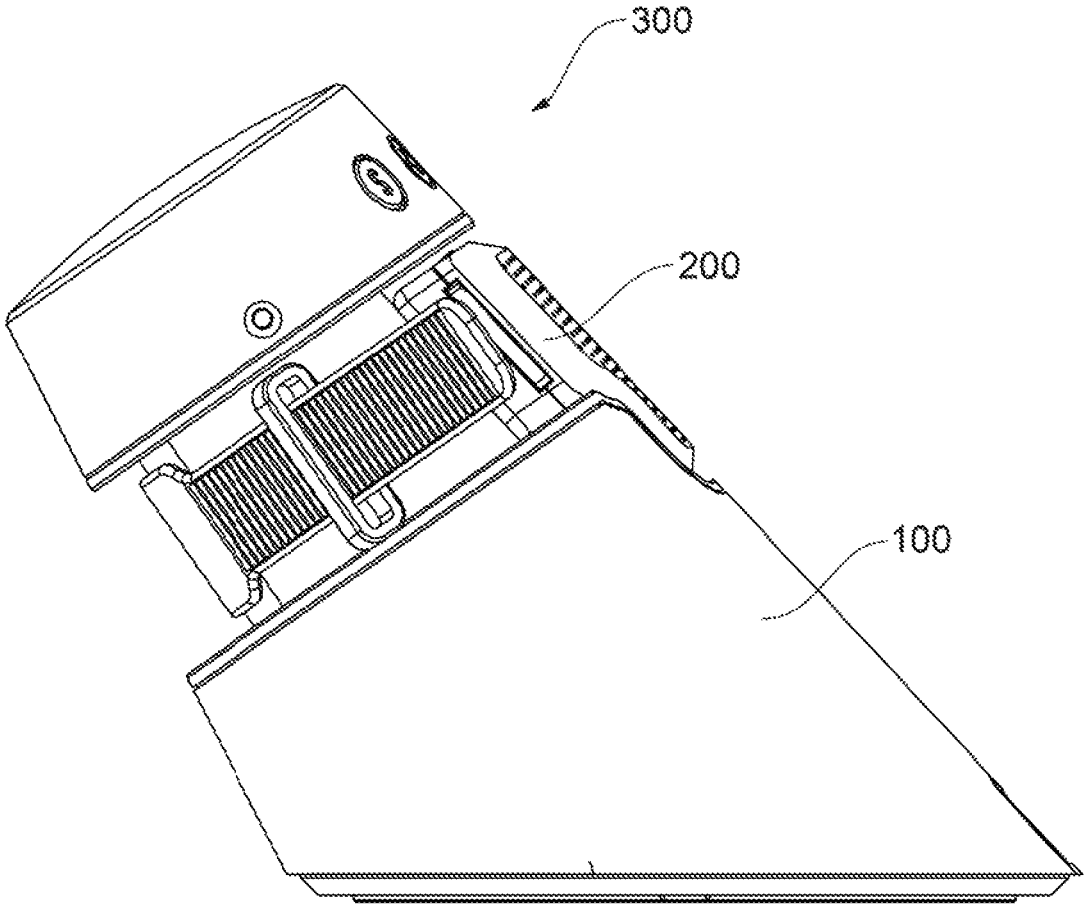
FIG. 10 shows a right side view of the user portion mounted on the alarm unit.
Figure 11:
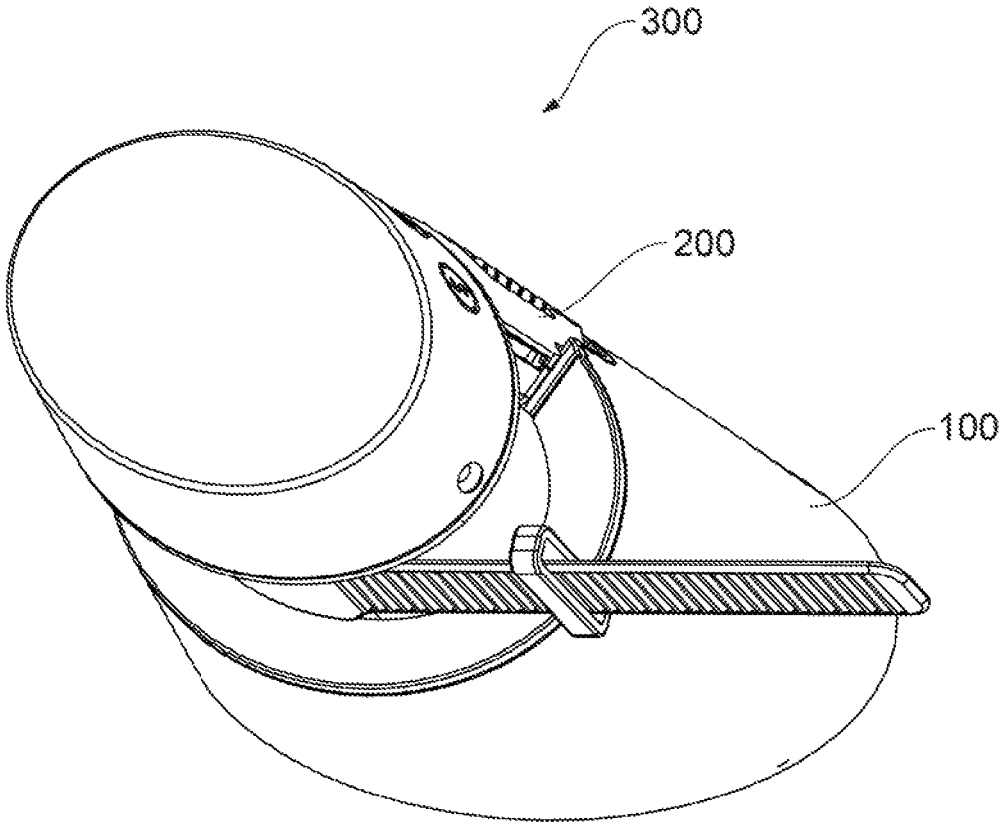
FIG. 11 shows a top view of the user portion mounted on the alarm unit.
Figure 12:
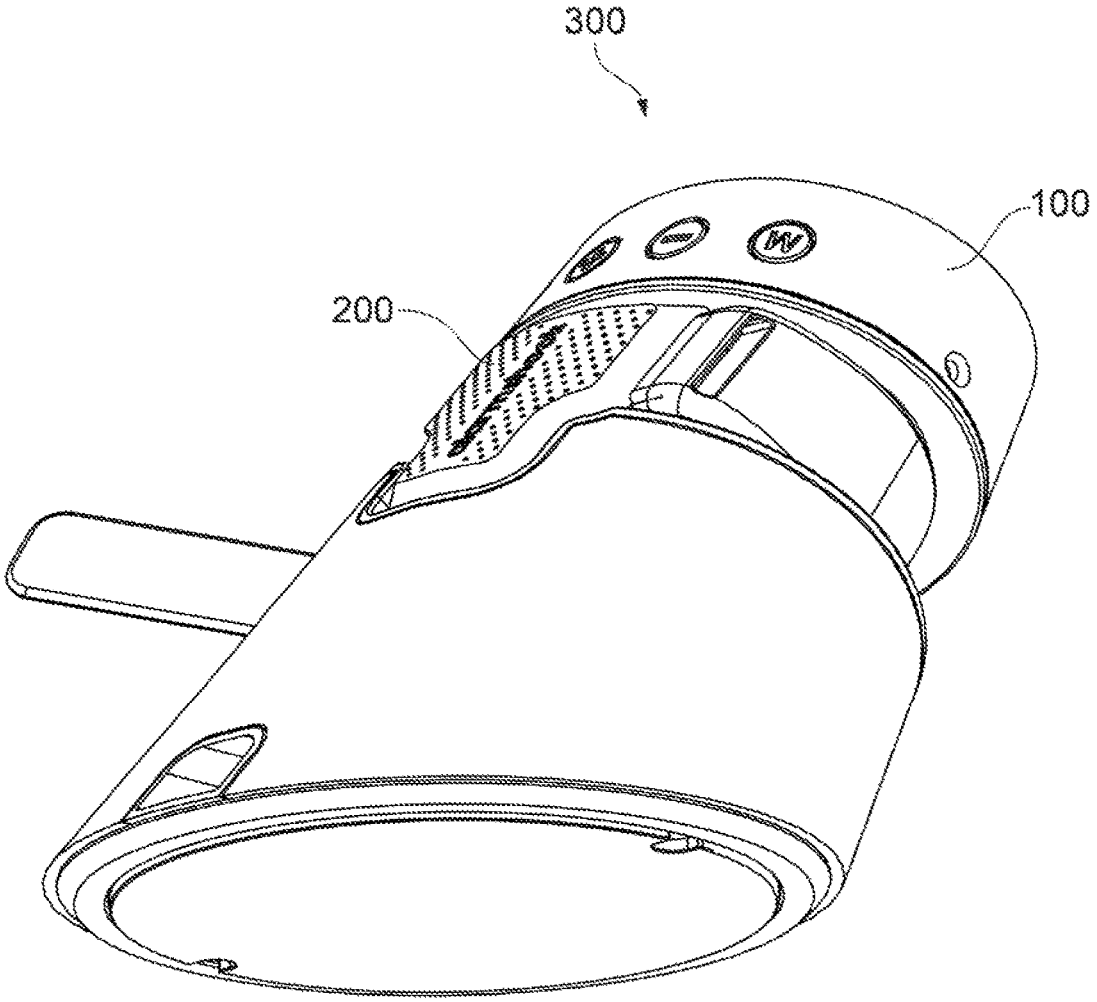
FIG. 12 shows an under view of the user portion mounted on the alarm unit.

FIGS. 7 to 17 show a second embodiment of the alarm apparatus 300. FIG. 7 shows the alarm unit 100 and user portion (wristband) 200 separately. FIGS. 8 to 12 show different views of the user portion 200 mounted on the alarm unit 100. The alarm unit 100 is frusto-conical, having a base 110 that is wider than the top 120. The alarm unit 100 has a recess 130 that is adapted to receive the user portion 200. In this way the user portion can be housed on the alarm unit 100 when not in use. Advantageously this permits the alarm apparatus 300 to be readily packaged for sale and transport.

The recess 130 also includes a depression 135 for receiving the contact plate of the user portion 200. The top 120 of the alarm unit 100 includes a display in the form of a screen that can display alarm information and the time. An outer face of the alarm unit 100 includes a plurality of control buttons 10 to allow a user to manually set and adjust the alerts. The alarm unit includes a charging port 140.

Figure 13:
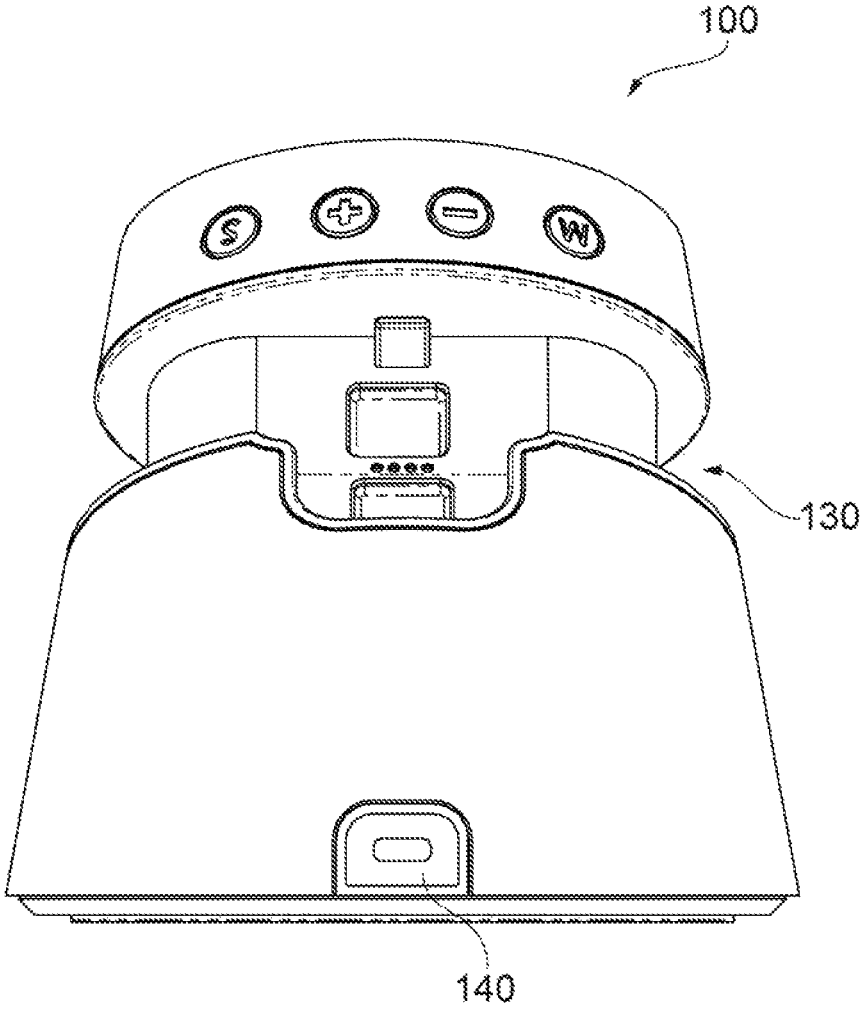
FIG. 13 shows a front view of the second embodiment of the alarm unit.
Figure 14:
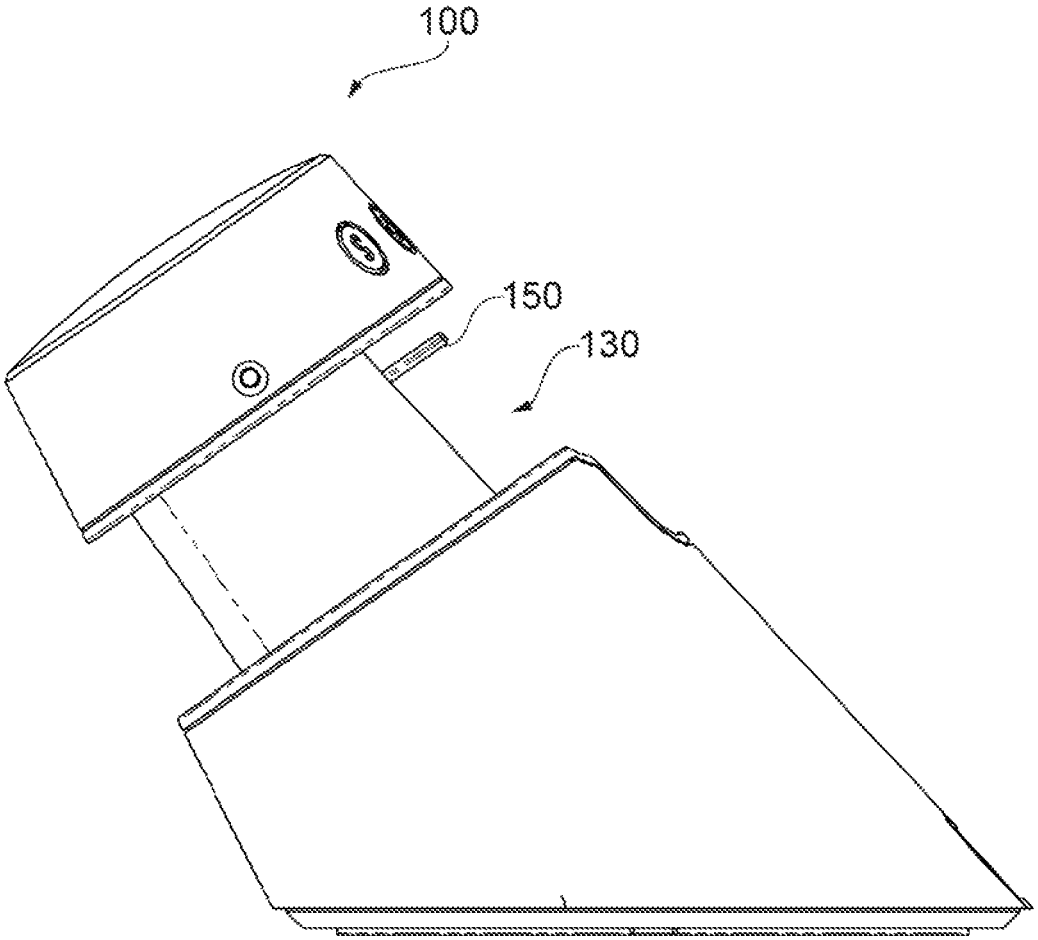
FIG. 14 shows a side view of the second embodiment of the alarm unit.
Figure 15:
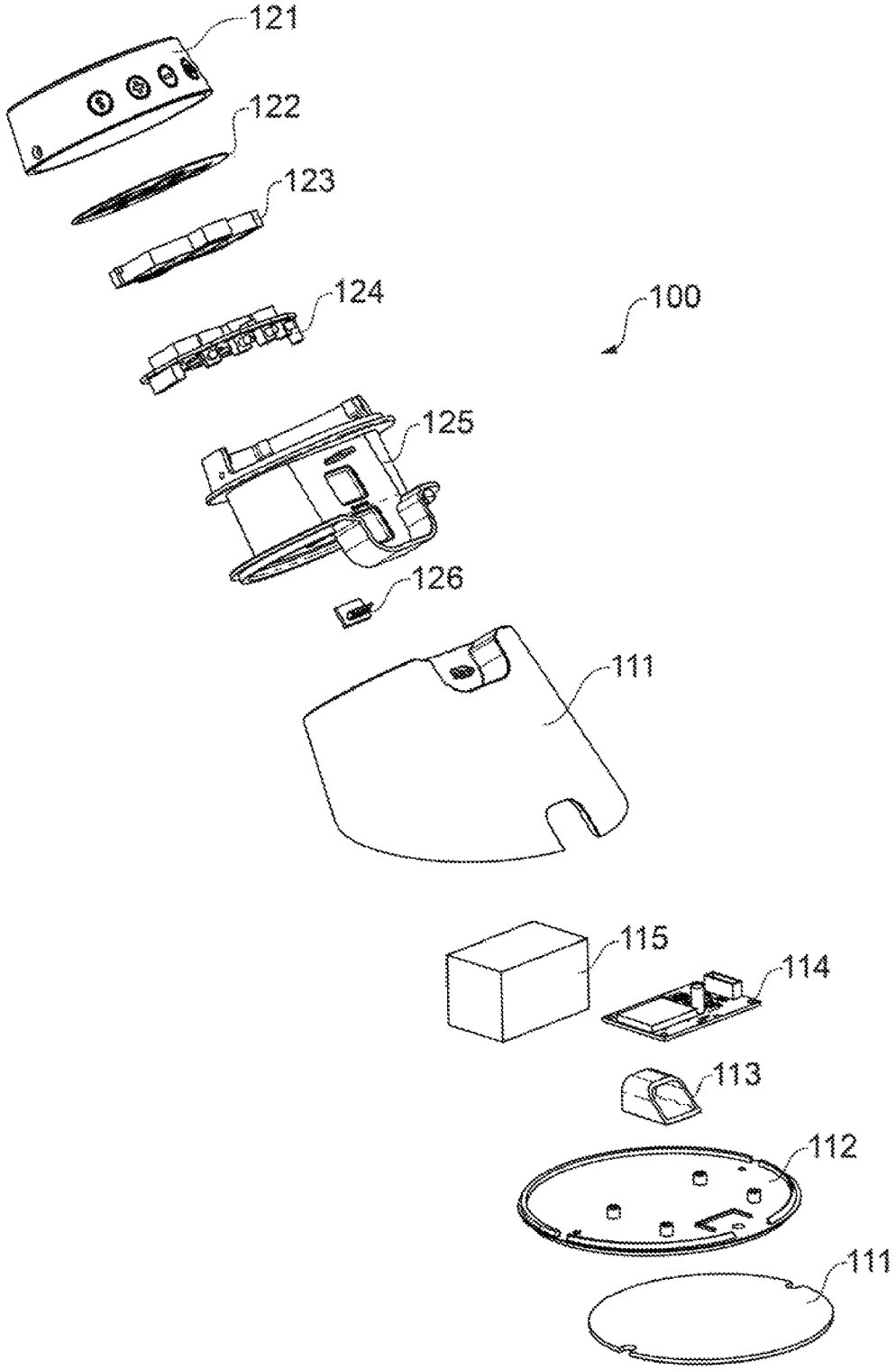
FIG. 15 shows an exploded view of the second embodiment of the alarm unit.

FIGS. 13 to 15 show different views of the alarm unit 100 with the user portion removed. FIG. 14 shows a plug 150 that is received by a socket 240 on the user portion. The plug 150 serves to locate the user portion 200 into the recess and prevents the lock from locking whilst on the alarm unit 100, even when the first and second ends 210A and 201B are engaged with one another. The plug 150 prevents the locking plate 202 from engaging with the second end 210B of the user portion.

FIG. 15 shows an exploded view of the alarm unit 100. The alarm unit has: an upper casing 121, a mask 122, baffles 123, a display and a Printed Circuit Board Assembly (PCBA) 124. Middle casing 125 has four pogo pins 126 for the PCBA. Lower casing 116 includes a weight 115; a power PCBA 114; a port surround 113; a base casing 112; and a base pad 111. The weight 115 ensures the alarm unit is stable when positioned on a surface. The pogo pins 126 connect with a terminal on the user portion 200 to permit charging and/or data transfer.

Figure 16:
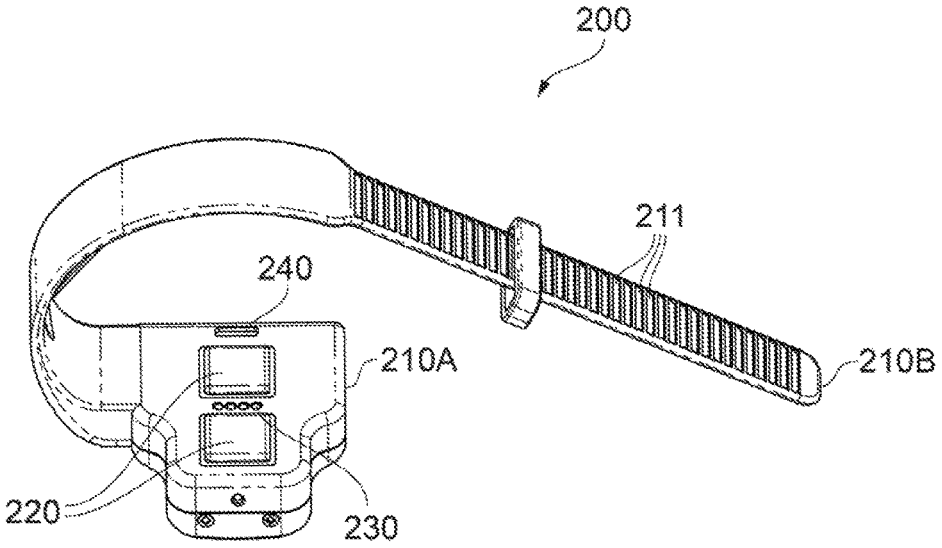
FIG. 16 shows the second embodiment of the user portion.
Figure 17:
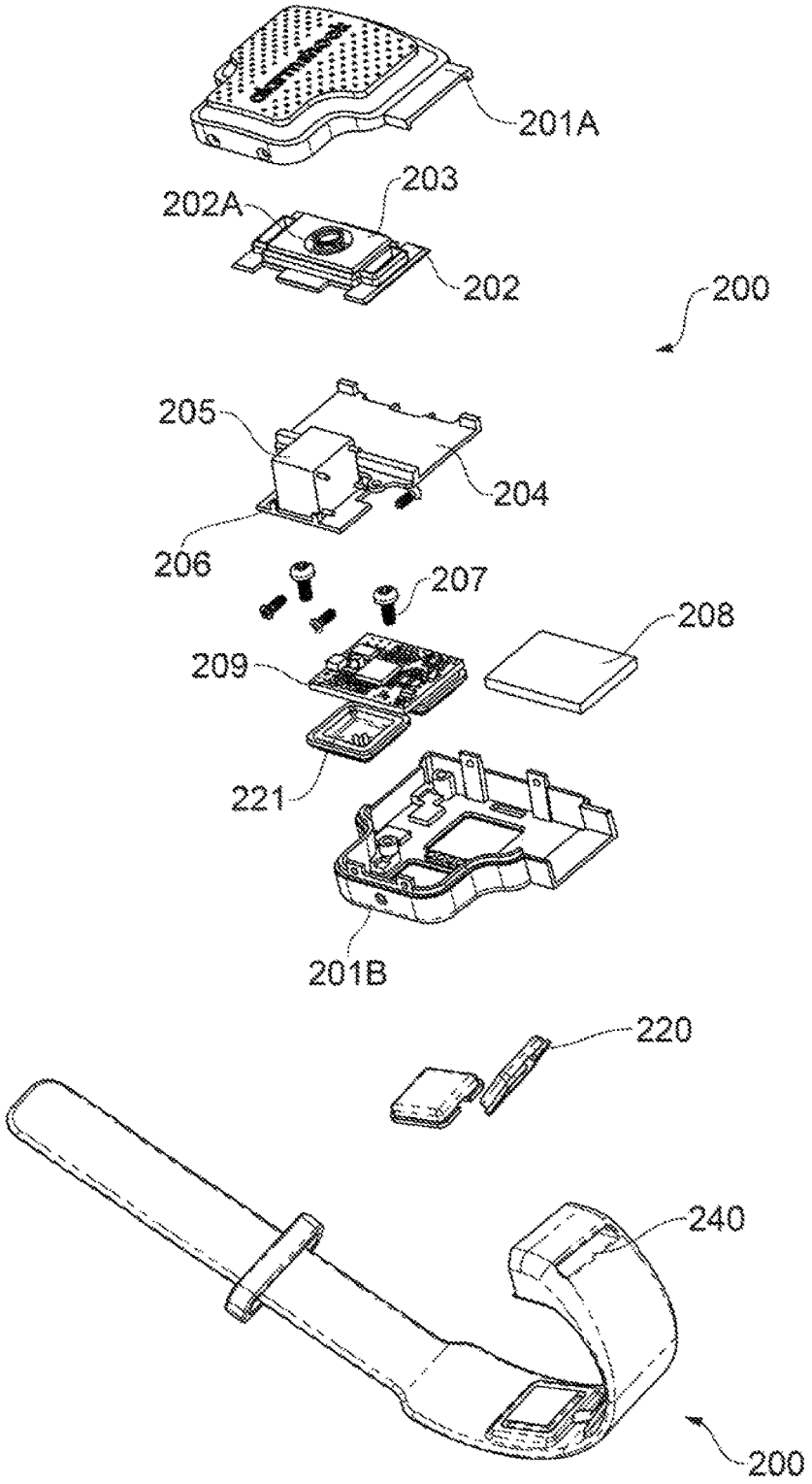
FIG. 17 shows an exploded view of the user portion.

FIGS. 16 and 17 show the second embodiment of the user portion 200. The user portion 200 has a first end 210A and a second end 210B. The ends 201A, 210B are joined in use so as to form a band around the user's wrist. The user portion 200 comprises: an upper casing 201A and a lower casing 201B; a locking plate 202; a magnet 203; a partition 204; a transformer 205; a transformer platform 206; connecting screws 207; a PCBA; a casing for the contacts 221; a battery 208 (typically a lithium battery) and two contacts 220.

The first end 210A includes a channel 240 (see FIG. 17) into which the second end 210B is received. The second end 210B has a plurality of grooves 211.

The channel includes displaceable, sprung locking plate 202 that is released to engage with and clamp the second end 210B in position wherein the locking plate 202 is in contact with the second end 210B. In this way the wristband is locked and cannot be removed. Typically the locking plate includes projections (not shown) that correspond with the grooves 211 so as to provide a more secure lock.

The locking plate 202 is mounted within the channel 240. The locking plate 202 is mounted on a spring 202A. The locking plate 202 includes a magnet 203 that enables the locking plate to be displaced from the second end 210B and spring 202A compressed when the user portion is presented to a second magnet (not shown) located within or on the alarm unit that serves to elevate the locking plate 202 from the second end 210B so that the second end 210B can be pull out of the channel 240.

The size and proportions of the user portion will be dependent on the required internal components. Unit materials could be a combination of synthetic plastic and metal, for example a high gloss plastic and brushed metal. The user portion 200 is ergonomically designed so as to allow for a comfortable sleep.

In use the alarm unit 100 may be placed in a different room, forcing the user to get out of bed to the location of the alarm unit so that the alert(s) can be deactivated. Therefore the use must move to the location of the alarm unit 100 so that the magnetic clasp can be opened by unlocking the attachment mechanism through interaction with the alarm unit 100. The user portion 200 must be placed in close proximity, if not touching, the alarm unit 100 so that the magnetic clasp is opened. Typically the user portion 200 is presented within 50 mm and preferably within 30 mm of the second magnet in or on the alarm unit 100. This system ensures the user gets out of bed promptly and avoids continued alerts such as vibrations or electric shocks.

The user portion 200 is typically stored on the alarm unit 100 when not in use. When the alarm apparatus is in use the user will put on the user portion. The magnetic clasp 1 locks in place and can only be removed by the alarm unit 100.

A user will set parameters on the alarm unit. Typically a user may also set their standard alarm on their mobile phone, the alarm apparatus 300 is set for the same time and programmed to activate the alerts at a preselected time after the initial alarm time. For example if the phone alarm and alarm apparatus are set for 07.00 the phone alarm sounds at 07.00 and the alerts are triggered to activate from 07.01 allowing a user one minute to make their way to the alarm unit and deactivate the alerts before they start. This delay period can be set by a user. In this way the mobile phone is considered a primary alarm and the alarm apparatus is a secondary alarm.

Once the input data from the alarm unit has been synced with the user portion the timer is activated, counting down to the alert time.

The primary alarm signal sounds, giving the user a pre-determined time period to get to the alarm unit and remove the user portion (wristband). The user may choose to ignore the alarm but will then be subject to the local alerts generated by the user portion, or they can get out of bed and unlock/deactivate the user portion by presenting it to the alarm unit 100. Once the user is up the user portion 200 can be located on the alarm unit and commence their day.

The invention has been described by way of examples only and it will be appreciated that variation may be made to the above-mentioned embodiments without departing from the scope of invention as defined by the claims.

The invention claimed is:

1. An alarm apparatus comprising:

an alarm unit; and a user portion separate from the alarm unit for generating a localized alert upon a pre-selected alert time, the user portion comprising:

an attachment means for attaching the user portion about or around a part of a body of a user, and a magnetically-releasable mechanical locking closure mechanism which in use is adapted to lock the attachment means about or around the part of the body of the user when the alert time is set, wherein the alarm unit and the user portion in use are located apart one from another, the user portion is programmed to provide the localized alert at the pre-selected alert time to wake the user, and the magnetically-releasable mechanical locking closure mechanism in use is adapted to unlock only upon physical proximity in a range of 300 mm or less to a magnetic field source in the alarm unit, and the localized alert is deactivated only upon physical proximity in the range of 300 mm or less of the user portion to the magnetic field source in the alarm unit.

2. The alarm apparatus according to claim 1 wherein:

the user portion includes a timer that triggers a means for generating the localized alert, and the timer is capable of being set by the alarm unit.

3. The apparatus according to claim 1 wherein:

the alarm unit emits an alert in dependence of the localized alert.

4. The alarm apparatus according to claim 1 wherein the alarm unit comprises:

a wireless transmitter adapted to transmit a wireless signal which activates the localized alert at the user portion.

5. The alarm apparatus according to claim 4 wherein:

the wireless transmitter is further adapted to be configured by a user to transmit the wireless signal to the user portion.

6. The alarm apparatus according to claim 1 wherein:

the localized alert is deactivated by the unlocking of the magnetically-releasable mechanical locking closure mechanism.

7. The alarm apparatus according to claim 1 wherein the user portion further comprises:

a snooze button function.

8. The alarm apparatus according to claim 1 wherein:

the user portion requires temporary physical contact to the alarm unit to deactivate the localized alert.

9. The alarm apparatus according to claim 1 wherein:

the user portion requires temporary physical contact to the alarm unit to unlock the magnetically-releasable mechanical locking closure mechanism.

10. The alarm apparatus according to claim 1 wherein:

the user portion is adapted to disable the localized alert by way of a wireless connection when the user portion is placed within a pre-defined range (user defined zone) from the alarm unit.

11. The alarm apparatus according to claim 1 wherein the user portion further comprises:

at least one data/charging port.

12. The alarm apparatus according to claim 1 wherein the alarm unit comprises:

at least one data/charging port.

13. The alarm apparatus according to claim 1 further comprising:

a data exchange/transfer means that is triggered to exchange/transfer data between the alarm unit and the user portion upon presentation of the user portion to the alarm unit.

14. The alarm apparatus according to claim 13 wherein:

the data exchange/transfer means is triggered upon a temporary physical contact of the user portion with the alarm unit.

15. The Ai alarm apparatus according to claim 1 wherein the user portion further comprises:

a memory arranged to store data relating to one or more parameters of the localized alert.

16. The Ai alarm apparatus according to claim 1 wherein the alarm unit comprises:

a memory arranged to store data relating to one or more parameters of the localized alert.

17. The Ai alarm apparatus according to claim 1 wherein the user portion further comprises:

terminals which in use contact the user's skin.

18. The alarm apparatus according to claim 1 wherein:

the user portion is in a form of a wrist band.

* * * * *